US007377126B2

(12) United States Patent
Gorbounov et al.

(10) Patent No.: US 7,377,126 B2
(45) Date of Patent: May 27, 2008

(54) REFRIGERATION SYSTEM

(75) Inventors: Mikhail B. Gorbounov, South Windsor, CT (US); Joseph J. Sangiovanni, West Suffield, CT (US); Igor B. Vaisman, West Hartford, CT (US)

(73) Assignee: Carrier Corporation, Farmington, CT (US)

( * ) Notice: Subject to any disclaimer, the term of this patent is extended or adjusted under 35 U.S.C. 154(b) by 386 days.

(21) Appl. No.: 11/180,774

(22) Filed: Jul. 13, 2005

(65) Prior Publication Data

US 2006/0016214 A1 Jan. 26, 2006

Related U.S. Application Data

(60) Provisional application No. 60/587,793, filed on Jul. 14, 2004.

(51) Int. Cl.
*F25B 41/00* (2006.01)

(52) U.S. Cl. ..... 62/513; 62/222; 62/434

(58) Field of Classification Search ..... 62/184, 62/222, 434, 513, 515, 527
See application file for complete search history.

(56) References Cited

U.S. PATENT DOCUMENTS

| | | | | |
|---|---|---|---|---|
| 2,097,602 | A | | 11/1937 | Rong |
| 3,976,128 | A | | 8/1976 | Patel et al. |
| 4,261,177 | A | | 4/1981 | Sterlini |
| 4,277,953 | A | | 7/1981 | Kramer |
| 4,309,987 | A | | 1/1982 | Higgins, Jr. |
| 4,382,468 | A | | 5/1983 | Hastwell |
| 4,448,347 | A | * | 5/1984 | Dunstan ..... 237/2 B |
| 4,524,823 | A | | 6/1985 | Hummel et al. |
| 4,593,539 | A | | 6/1986 | Humpolik et al. |
| 4,903,761 | A | | 2/1990 | Cima |
| 5,103,559 | A | | 4/1992 | Hoffmuller |
| 5,245,843 | A | * | 9/1993 | Shimoya et al. ..... 62/515 |
| 5,343,620 | A | | 9/1994 | Velluet |
| 5,523,607 | A | | 6/1996 | Zambrano |
| 5,651,268 | A | | 7/1997 | Aikawa et al. |
| 5,704,221 | A | | 1/1998 | Lego |
| 5,743,111 | A | | 4/1998 | Sasaki et al. |
| 5,765,393 | A | | 6/1998 | Shlak et al. |
| 5,806,586 | A | | 9/1998 | Osthues et al. |
| 5,881,456 | A | | 3/1999 | Bergins et al. |
| 5,901,785 | A | | 5/1999 | Chiba et al. |
| 5,921,315 | A | * | 7/1999 | Dinh ..... 165/104.21 |
| 5,931,220 | A | | 8/1999 | Ueda et al. |
| 5,941,303 | A | | 8/1999 | Gowan et al. |

(Continued)

FOREIGN PATENT DOCUMENTS

GB 2250336 6/1992

(Continued)

*Primary Examiner*—Melvin Jones
(74) *Attorney, Agent, or Firm*—Marjama Muldoon Blasiak & Sullivan LLP

(57) ABSTRACT

In a refrigeration system having a pressurizer, a condenser, an expansion device and an evaporator, with the evaporator having an inlet header, an outlet header, and a plurality of channels therebetween, the outlet header has a liquid outlet and a vapor outlet and provision is made for separation of refrigerant liquid from refrigerant vapor. The liquid refrigerant is passed through a superheating heat exchanger to obtain complete evaporation and superheating prior to passing to the pressurizer. Various other features are provided to enhance the system operation.

24 Claims, 7 Drawing Sheets

U.S. PATENT DOCUMENTS

| | | | | |
|---|---|---|---|---|
| 6,018,954 | A * | 2/2000 | Assaf | 62/94 |
| 6,053,243 | A | 4/2000 | Kato et al. | |
| 6,179,051 | B1 | 1/2001 | Ayub | |
| 6,286,590 | B1 | 9/2001 | Park | |
| 6,394,176 | B1 | 5/2002 | Marsais | |
| 6,397,936 | B1 | 6/2002 | Crowley et al. | |
| 6,430,945 | B1 | 8/2002 | Haussmann | |
| 6,470,703 | B2 | 10/2002 | Wada et al. | |
| 6,484,797 | B2 | 11/2002 | Saito et al. | |
| 6,666,909 | B1 | 12/2003 | TeGrotenhuis et al. | |
| 6,688,137 | B1 | 2/2004 | Gupte | |
| 6,688,138 | B2 | 2/2004 | DiFlora | |
| 6,729,386 | B1 | 5/2004 | Sather | |
| 6,796,374 | B2 | 9/2004 | Rong | |
| 6,814,136 | B2 | 11/2004 | Yi et al. | |
| 6,986,385 | B1 * | 1/2006 | Gilles et al. | 165/202 |
| 6,988,539 | B2 | 1/2006 | Kato et al. | |
| 7,021,371 | B2 | 4/2006 | Saito et al. | |
| 7,143,605 | B2 | 12/2006 | Rohrer et al. | |
| 2002/0174978 | A1 | 11/2002 | Beddome et al. | |
| 2003/0010483 | A1 | 1/2003 | Ikezaki et al. | |
| 2003/0116310 | A1 | 6/2003 | Wittmann et al. | |

FOREIGN PATENT DOCUMENTS

| | | |
|---|---|---|
| JP | 4295599 | 10/1992 |
| JP | 6159983 | 6/1994 |
| JP | 2001304775 | 10/2001 |
| WO | WO-9414021 | 6/1994 |

* cited by examiner

REFRIGERATION SYSTEM

CROSS REFERENCE TO RELATED APPLICATION

This application claims priority to and the benefit of U.S. Provisioanl Patent Application Ser. No. 60/587,793, filed Jul. 14, 2004, and entitled REFRIGERATION SYSTEM, which application is incorporated herein by this reference.

TECHNICAL FIELD

The invention relates generally to refrigeration systems and, more particularly to evaporators with parallel tubes requiring distribution of two-phase refrigerant.

The non-uniform distribution of two phase refrigerant in parallel tubes, for example in mini- or micro-channel heat exchangers, can significantly reduce heat exchanger efficiency. This is called maldistribution and is a common problem in heat exchangers with parallel refrigerant paths. Two-phase maldistribution problems are caused by the difference in density of the vapor and liquid phases.

In addition to the reduction of efficiency, two phase maldistribution may result in damage to the compressor because of liquid slugging through the evaporator.

DISCLOSURE OF THE INVENTION

The purpose of the current invention is to eliminate the evaporator deficiency associated with the maldistribution of two-phase refrigerant and to eliminate any harmful effect associated with liquid slugging through the evaporator. At the same time the invention avoids increased sizes and costs associated with additional components, such as, a superheating heat exchanger handling excessive thermal loads.

The present invention provides a closed loop refrigeration system comprising at least the following components: a suction line, a pressurizing means, a condenser, a liquid line, a superheating heat exchanger an expansion device, and an evaporator for cooling fluid. The evaporator has an inlet header, an outlet header, and refrigerant channels between the headers. External surfaces of the refrigerant channels are thermally exposed to the chilled or cooled fluid. The evaporator outlet header has a liquid outlet, a vapor outlet, and a means for liquid separation. The superheating heat exchanger has a high-pressure side and a low-pressure side. The high-pressure side carries liquid refrigerant from the liquid line. The low-pressure side carries refrigerant from the liquid outlet of the outlet header. The superheating heat exchanger is sized for complete evaporation of the non-evaporated liquid portion and provides a superheat at its low-pressure side outlet as required at evaporators outlets in each particular application.

Another major aspect of the invention is based on the inclusion of a liquid separator, which has a liquid outlet feeding the evaporator inlet header and a vapor outlet connected to the suction line at the outlet from the vapor outlet of the outlet header.

In the current invention the means for liquid separation in the evaporator outlet header is based on the gravity. The liquid outlet is placed in accordance with the direction of the gravity force and carries the non-evaporated liquid portion of two-phase refrigerant stream as it appears at the outlets from the channels of the evaporator. The vapor outlet is placed in accordance with the opposite direction of the gravity force and carries the vapor portion of two-phase refrigerant stream from the evaporator to the suction line.

The diameters of the outlet header and of the liquid outlet are sized to provide adequate mass fluxes from the vapor and liquid outlets of the outlet header. The vapor outlet from the outlet header may have a restriction to compensate for pressure drop in the low-pressure side of the superheating heat exchanger. Also, the vapor outlet from the liquid separator may have a restriction to compensate for pressure drop in the evaporator. The pressuring means for vapor compression systems is a compressor. The pressurizing means for absorption systems consists of at least an absorber, a pump, and a generator. Air cooling evaporators use air as fluid; however, in other applications various secondary refrigerants are applicable. The expansion device may be used as a thermal expansion valve with a sensing bulb attached to the vapor outlet of the vapor header. When the liquid separator is applied, the sensing bulb is attached to the vapor outlet of the header downstream in respect to connection of the vapor outlet from the liquid separator. The expansion device, the liquid separator (if applied), the evaporator, and the superheating heat exchanger may be arranged as a common evaporator unit. There is an option to have a liquid-to-suction heat exchanger, which provides thermal contact liquid refrigerant outgoing from the condenser and vapor refrigerant outgoing from the low- pressure side of the superheating heat exchanger. The liquid line may consist of two parallel lines: a main liquid line with a main expansion device; and an additional line with the high-pressure side of the superheating heat exchanger and an additional expansion device. If the additional expansion device is a thermal expansion valve, then a sensing bulb may be attached to a vapor outlet of the superheating heat exchanger. If the additional expansion device is a capillary tube and the superheating heat exchanger is a shell-tube heat exchanger, then the capillary tube may be applied at the high-pressure side of the superheating heat exchanger inside the shell of the heat exchanger.

In the current invention the superheating heat exchanger is sized for complete evaporation of the non- evaporated liquid portion and provides a superheat at its low-pressure side outlet as required at evaporators outlets in each particular application. Since a superheating zone is removed from the evaporator, the evaporator capacity is substantially enhanced. Also, the reduced vapor quality at the evaporator inlet leads to improvement of the evaporator capacity. Since in the current invention the superheating heat exchanger involves just a portion of the entire mass flux provided by the compressor, costs and dimensions of the superheating heat exchanger are reduced as well.

DETAILED DESCRIPTION OF THE INVENTION

Figure 1A:
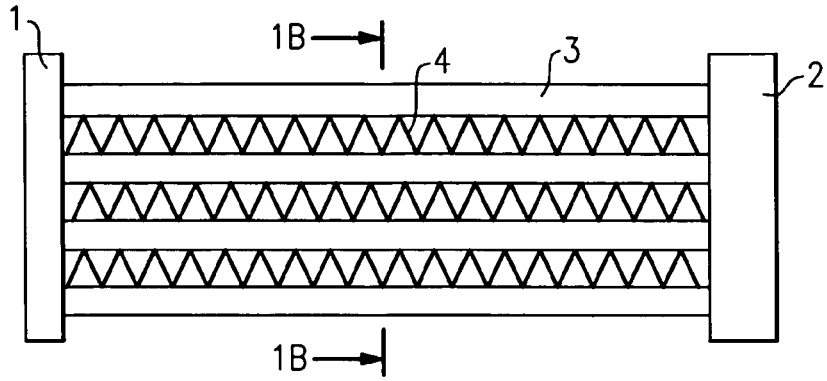
FIGS. 1A and 1B are illustrative of a mini-channel heat exchanger in accordance with the present invention.
Figure 1B:
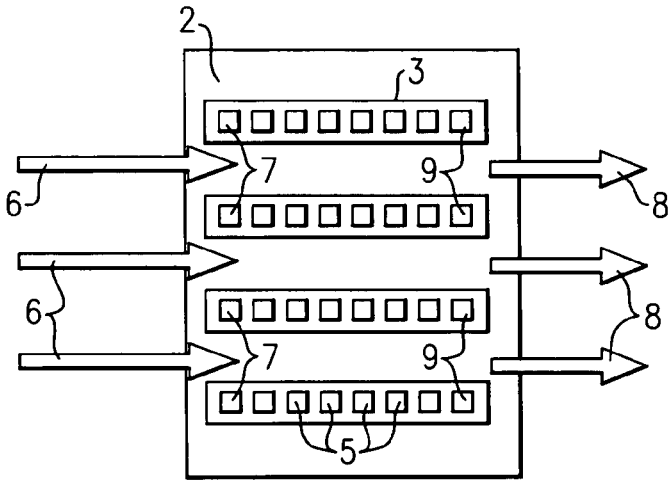

FIG. 1 shows a mini-channel or micro-channel heat exchanger with inlet header 1, outlet header 2, and tubes 3 interlaced with fins 4 externally exposed to a fluid to be chilled or cooled in the heat exchanger. As shown on the cross-sectional view, each tube 3 consists of a number of channels 5 to carry evaporating refrigerant. In the inlet to the inlet header 1 two-phase refrigerant is delivered to each tube and to each channel of tubes. Fluid inlet 6 faces first channels 7 of each tube and fluid outlet 8 faces last channels 9 of each tube. Obviously, this arrangement is a cross flow one.

The first challenge is to distribute equal amount of liquid and vapor portions of two-phase refrigerant between each tube. The second challenge is to distribute equal liquid and vapor portions of two-phase refrigerant between each channel of each tube. Refrigerant distributors have been useful to resolve the first challenge, but, the second challenge has remained unsolved. For example, air conditioners may have fluid temperature at inlet 5 equal to 80° F. and fluid temperature at outlet 6 equal to 58° F.; evaporating temperature is 45° F. In such cases loading temperature difference on the first channel is 80−45=35° R, but loading temperature difference on the last channel is 58−45=13° R, that is, 37% in respect to the loading temperature difference and thermal load on the first channel. If the first channel is properly fed and fully loaded, then the last channel is not fully loaded, liquid in the last channel is not fully evaporated and slugs through the evaporator, and the heat exchanger efficiency is equal to (100+37)/2=68.5% approximately. If the last channel is properly fed and fully loaded, then the first channel is overloaded, refrigerant in the first channel is substantially superheated and the heat exchanger deficiency is significant.

Figure 2:
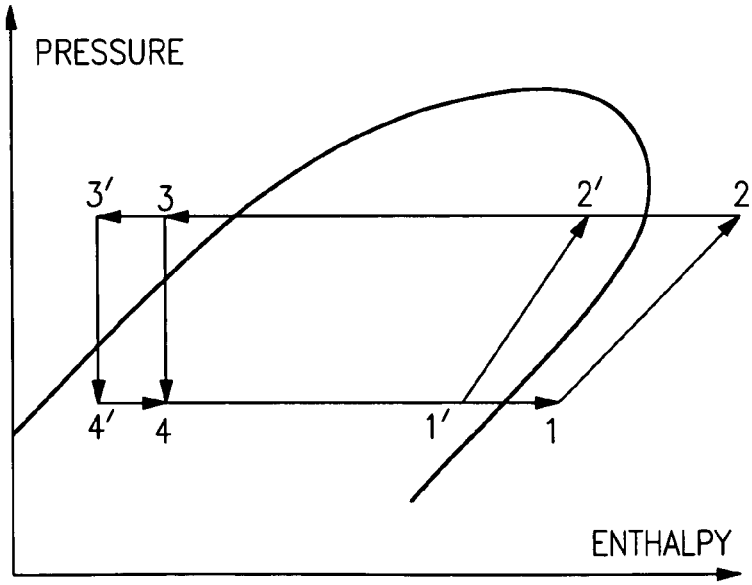
FIG. 2 is pressure enthalpy diagram thereof.

Effect of the maldistributed refrigerant is shown in FIG. 2. If no maldistribution exists, the regular vapor compression cycle for a compressor, a condenser, an expansion device, and an evaporator, is shaped as 1-2-3-4-1, where 1—is the compressor suction, 2—is the compressor discharge, 3—is the condenser outlet/expansion device inlet, 4—is the evaporator inlet. If maldistribution of refrigerant takes place, some circuits of evaporators may be fed mostly by vapor and some circuits may be fed mostly by liquid. As a result, some circuits may have superheated vapor and some circuits may have liquid at their outlets. Appearance of liquid at the outlet, re-shapes the above-mentioned cycle to a shape 1'-2'-3-4-1' and the compression process 1'-2' is moved to the two-phase zone. The non-evaporated liquid portion does not contribute in cooling of the fluid pumped through the evaporator and, as a result, the evaporator capacity is reduced. In addition, a compressor may be damaged if the non-evaporated liquid reaches its suction port. An attempt to design an evaporator operating with excessive refrigerant superheat to ensure no liquid at the evaporator outlet would result in further reduction of the evaporator capacity and COP.

The current invention is intended to complete evaporation, accomplish slight superheating in a superheating heat exchanger and to provide the cycle 1-2-3-3'-4'-1'-1, where 1,-1 is superheating of vapor in the superheating heat exchanger; 3-3' is sub-cooling of liquid in the superheating heat exchanger; and 4'-1' is cooling effect. Enthalpy difference of the process 4'-1' is equal to enthalpy difference of the process 4-1 of the regular vapor compression cycle.

Figure 3:
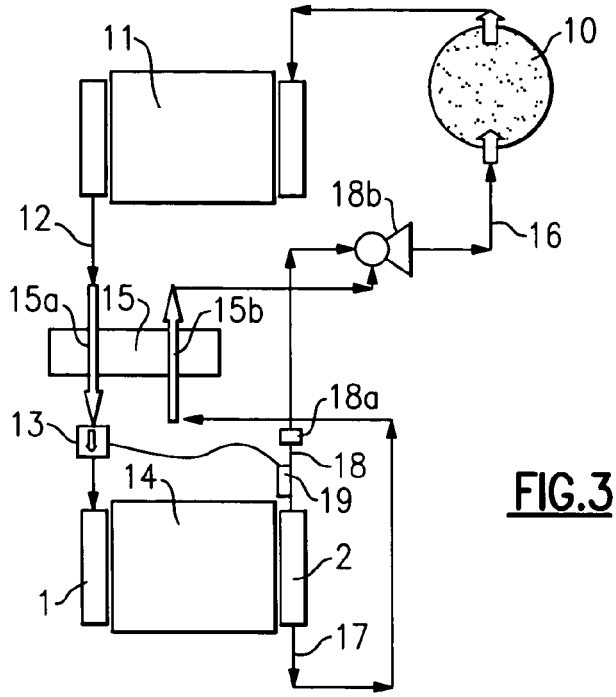
FIG. 3 is a schematic illustration of a refrigeration system with a superheating heat exchanger in accordance with one aspect of the present invention.

In accordance with FIG. 3 a refrigeration system consists of a closed loop with a compressor 10, a condenser 11, a liquid line 12, an expansion device 13, an evaporator 14 for cooling a fluid, superheating heat exchanger 15 and a suction line 16.

The evaporator 14 has the inlet header 1 and the outlet header 2. The outlet header 2 has a liquid outlet 17, a vapor outlet 18, and a means for liquid separation. The means for liquid separation are based on the gravity. The liquid outlet 17 is placed in accordance with the direction of the gravity force and the vapor outlet 18 is placed in accordance with the opposite direction of the gravity force. The liquid outlet 17 carries liquid and lubricant and the vapor outlet 18 carries vapor. The cross-sectional area of the vapor outlet header 2 and the cross-sectional area of the liquid outlet 17 are sized to provide adequate refrigerant mass fluxes from the outlets 17 and 18.

The superheating heat exchanger 15 provides thermal contact between a high-pressure side 15*a* and a low-pressure side 15*b*. The high-pressure side 15*a* carries liquid refrigerant from the liquid line 12 at the inlet to the expansion device 13. The low-pressure side 15*b* carries liquid refrigerant mixed with lubricant outgoing from the liquid outlet 17. The heat exchanger 15 is sized to provide complete evaporation of liquid refrigerant appeared in the outlet header 2 of the evaporator 14 and to accomplish some superheat at its low pressure outlet, recuperating heat to liquid refrigerant flowing through the liquid line 12. The superheat at the outlet from the low-pressure side 15*b* of the superheated heat exchanger 15 should be the same as required at evaporators outlets in each particular application. It is important to note that the more substantial the two-phase refrigerant maldistribution is, the higher thermal loads are to be maintained, and the bigger sizes of the superheating heat exchanger 15 are required. Therefore, any efforts reducing the maldistribution should be considered and might be beneficial.

The vapor outlet 18 may have a restrictor 18*a* to compensate for pressure drop in the low-pressure side 15*b* of the superheating heat exchanger 15.

Alternatively, the vapor outlet 18 may be connected to the driving side of an ejector pump 18*b* with the vapor outlet of the superheating heat exchanger connected to the driven side of the ejector pump 18*b* to compensate for pressure drip in the low-pressure side 15*b* of the superheating heat exchanger 15.

The expansion device 13, the evaporator 14, and superheating heat exchanger 15 may be incorporated in one evaporator unit.

The expansion device 13 may be implemented as a capillary tube or as an orifice. If the expansion device 13 is an expansion valve, then a sensing bulb 19 of the valve should be located at outlet from the vapor outlet 18.

Figure 4:
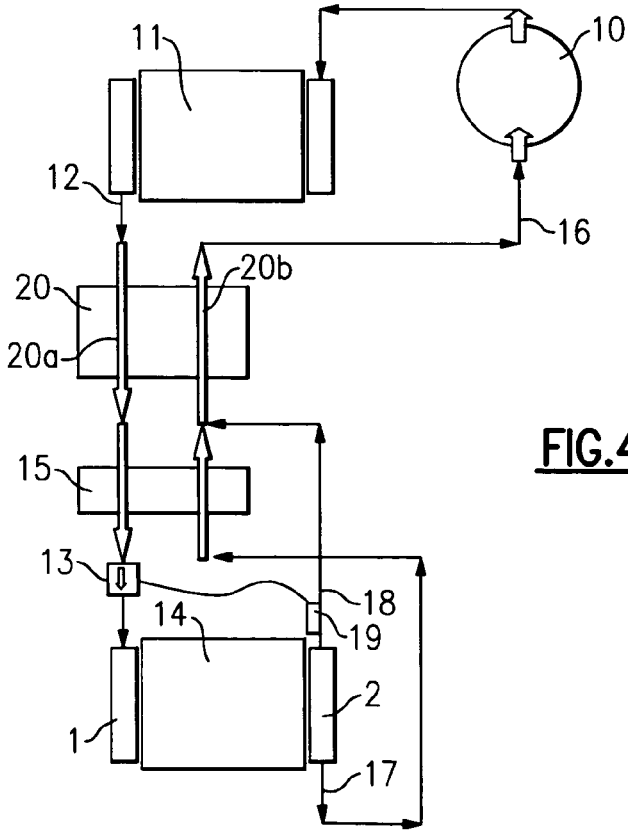
FIG. 4 is a schematic illustration of an evaporator with a superheating heat exchanger and a liquid-to-suction heat exchanger in accordance with one aspect of the present invention.

FIG. 4 illustrates the difference between the traditional liquid-to-suction heat exchanger and the superheating heat exchanger 15. FIG. 4 shows a refrigeration system with a liquid-to-suction heat exchanger 20 providing thermal contact between a high-pressure side 20*a* and a low-pressure side 20*a*. The high-pressure side 20*a* carries liquid refrigerant from the liquid line 12 prior to the inlet to the superheating heat exchanger 15. The low-pressure side 20*b* carries vapor from the superheating heat exchanger 15 to the compressor 10. The liquid-to suction heat exchanger 20 is not intended for the completion of the evaporation process as the superheating heat exchanger 15 is intended for. The function of the liquid-to-suction heat exchanger is to substantially increase superheat in the suction line 16 and to substantially increase a sub-cooling in the liquid line 12.

Figure 5:
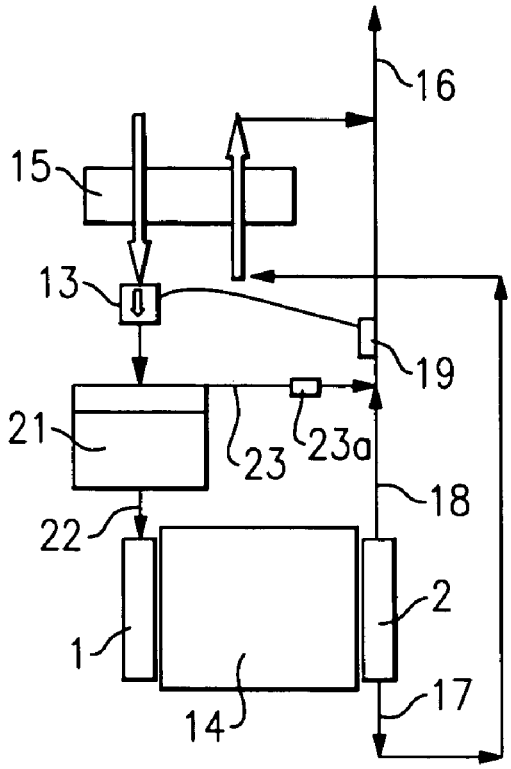
FIG. 5 is a schematic illustration of the present invention employing a liquid separator.

FIG. 5 presents employment of a liquid separator 21. The liquid separator 21 has two outlets: liquid outlet 22 and vapor outlet 23. The liquid outlet 22 feeds the inlet header 1 of the evaporator 14. The vapor outlet 23 is connected to the suction line 16 outgoing from the vapor outlet 18 of the outlet header 2. The vapor outlet 23 may have a restrictor 23*a* as a compensator for refrigerant pressure drop in the evaporator 14 and its headers 1 and 2.

The expansion device 13, the evaporator 14, the superheating heat exchanger 15, and the liquid separator 21 may be incorporated in one evaporator unit.

The expansion device 13 may be implemented as a capillary tube or as an orifice. If the expansion device 13 is an expansion valve, then the sensing bulb 19 of the valve should be located at outlet from the vapor outlet 18 after a line connecting the vapor outlet 23 and the suction line 16.

Figure 6:
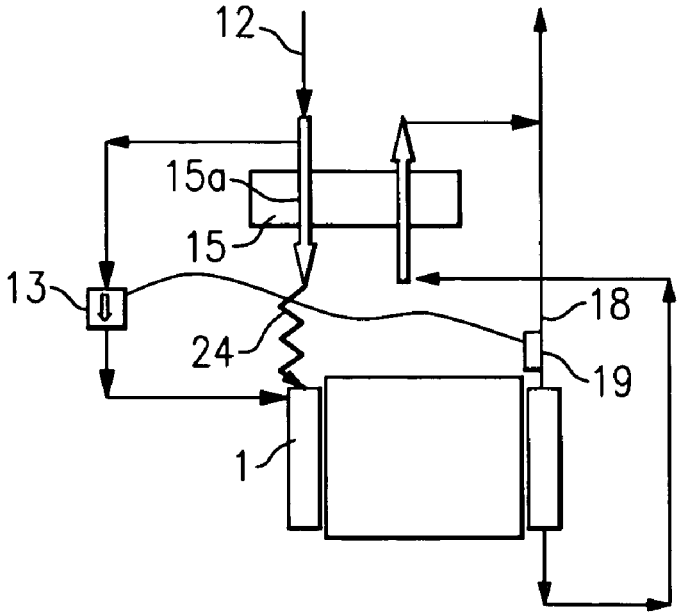
FIG. 6 is a schematic illustration of the present invention employing two split liquid lines with two expansion devices.

FIG. 6 illustrates a refrigeration system with the liquid line 12 split into two parts. The first part carries a major part of liquid refrigerant mass flux, and has the expansion device 13 attached to the inlet header 1. The second part, which carries the remainder of the mass flux, includes the high-pressure side 15*a* of the superheating heat exchanger 15 and an additional expansion device 24 attached to the inlet header 1 as well.

If the expansion device 13 is an expansion valve, then the sensing bulb 19 of the valve should be located at outlet from the vapor outlet 18.

Figure 7:
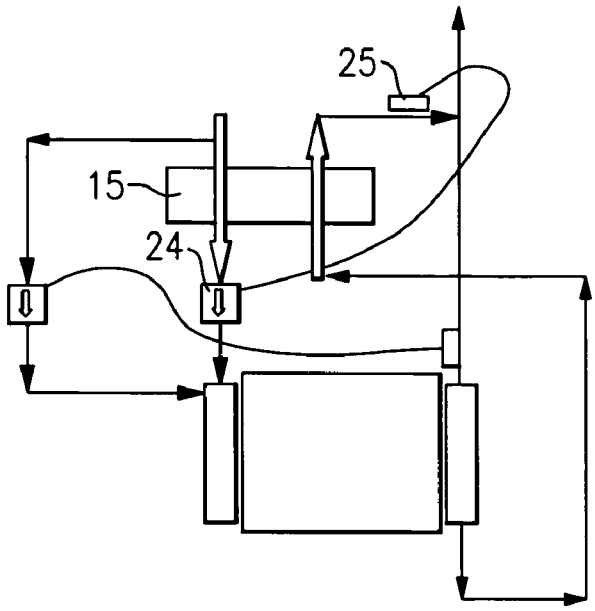
FIG. 7 is a schematic illustration of the present invention employing two split liquid lines with two expansion valves.

It the expansion device 24 is an expansion valve, then a sensing bulb 25 of the valve should be located at outlet from the low-pressure refrigerant of the superheating heat exchanger 15 as per FIG. 7. In this case the expansion valve 24 operates on a reversed principle: it opens its orifice when the superheat is decreased, and it closes its orifice when superheat is increased.

Figure 8:
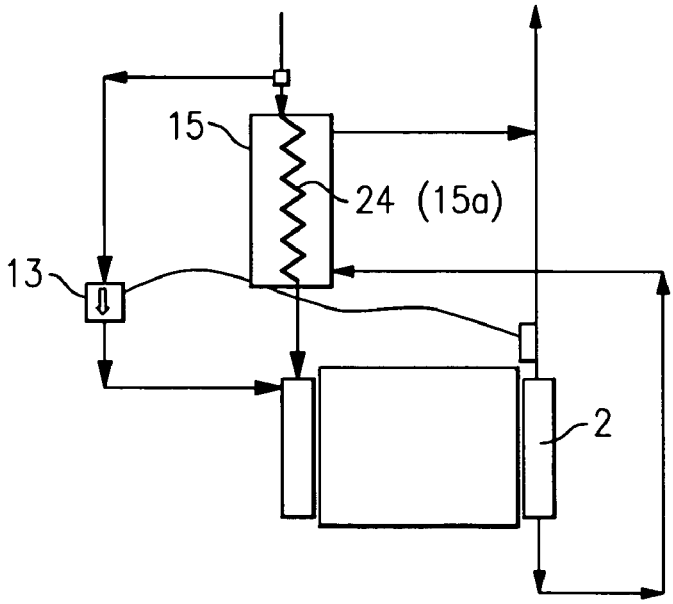
FIG. 8 is a schematic illustration of the present invention employing two split liquid lines and a capillary tube inside the shell of a superheating heat exchanger.

If the expansion device 24 is a capillary tube, the capillary tube may be used as the high-pressure side 15*a* of the superheating heat exchanger 15 (i.e. within the superheating heat exchanger 15) as shown on FIG. 8. When, as a result of maldistribution, the amount of liquid in the outlet header 2 is increased, then the cooling effect on the capillary tube is increased as well, and the capillary tube capacity is increased as well. Thus, the increased refrigerant mass flow rate through the high-pressure side handles the increased amount of liquid in the outlet header 2.

Figure 9:
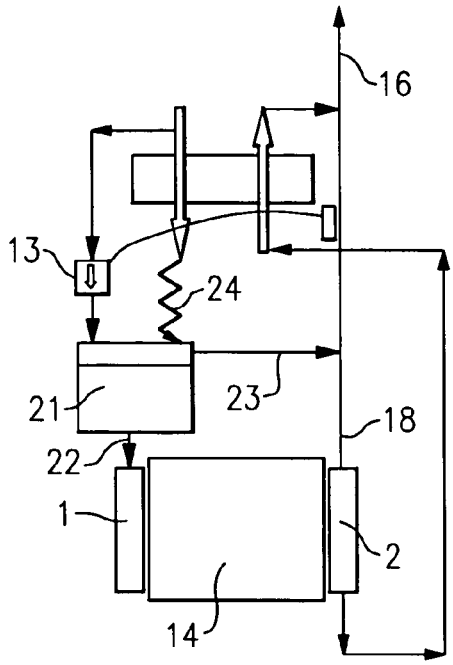
FIG. 9 is a schematic illustration of the present invention employing two split liquid lines and a liquid separator.

FIG. 9 adds the liquid separator 21 to the schematic of FIG. 6. Refrigerant expanded in the expansion device 13 and in the expansion device 24 feeds the liquid separator 21. The liquid outlet 22 feeds the inlet header 1 of the evaporator 14. The vapor outlet 23 is connected to the suction line 16 outgoing from the vapor outlet 18 of the outlet header 2. All components on FIG. 9 may be incorporated in one evaporator unit.

A liquid-to-suction heat exchanger is applicable to systems accommodating arrangements in FIG. 5, FIG. 6, FIG. 7, FIG. 8, and FIG. 9 in the same way as the liquid-to-suction heat exchanger shown on FIG. 4.

Figure 10:
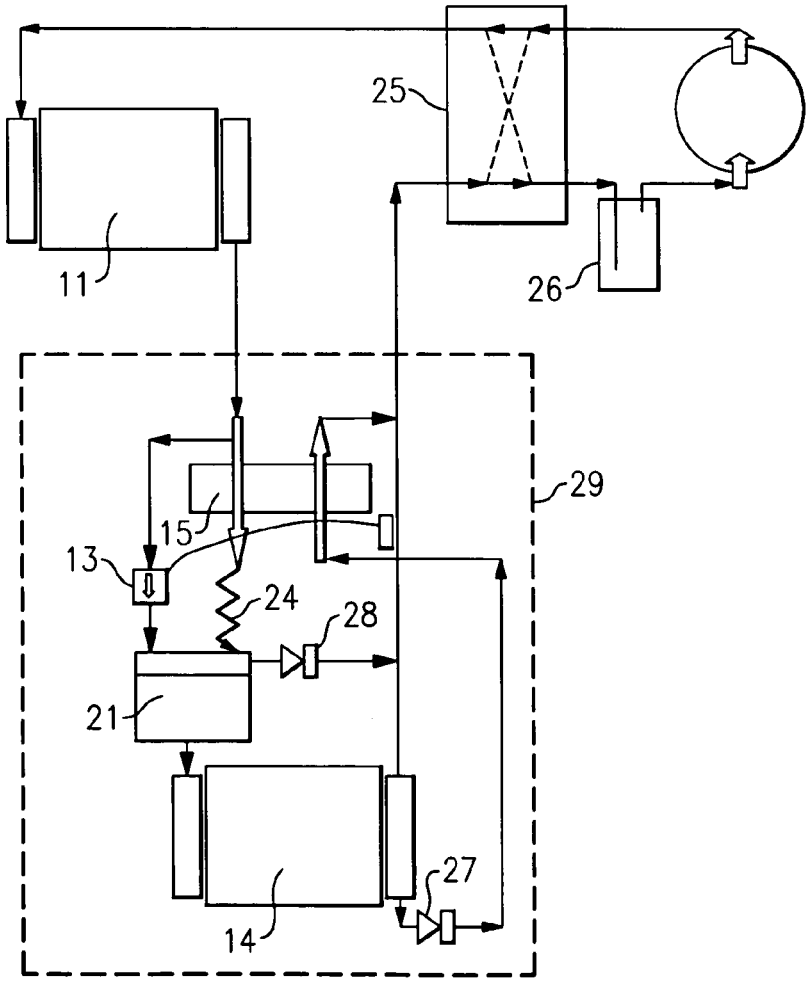
FIG. 10 is a schematic illustration of vapor-compression refrigeration system operating in a cooling mode in accordance with one aspect of the invention.
Figure 11:
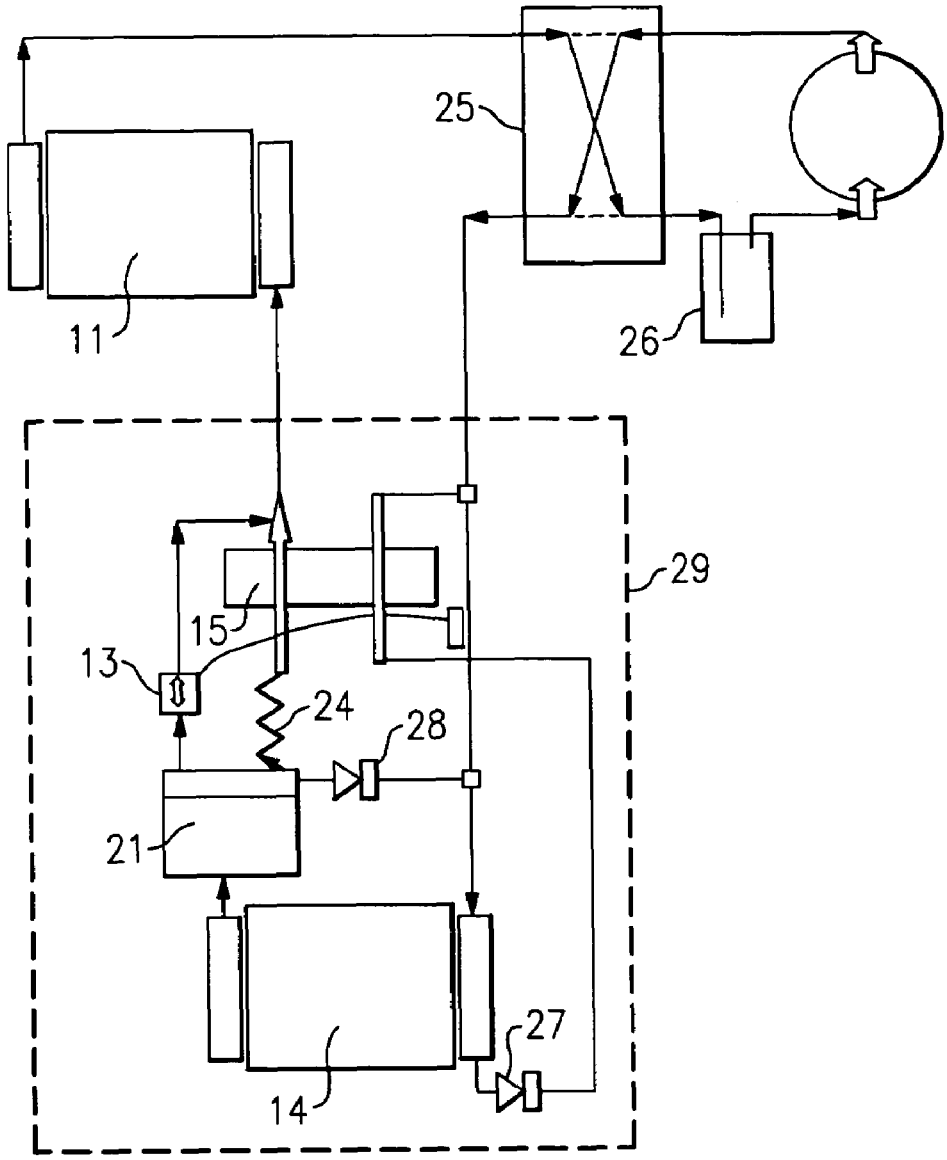
FIG. 11 is a schematic illustration of vapor-compression refrigeration system operating in a heating mode in accordance with one aspect of the invention.

FIG. 10 and FIG. 11 show a refrigerating system based on FIG. 8, but designed to operate in respective cooling and heating modes utilizing components shown in FIG. 9. FIG. 10 relates to the cooling mode and FIG. 11 relates to the heating mode. To enable the heating mode the refrigeration system has a fourway valve 25 and a suction accumulator 26 to handle refrigerant charge imbalance in the heating and cooling modes. Also, the system is equipped with check valves 27 and 28 in order to disable undesirable refrigerant streams when the operating mode is reversed from the cooling mode to the heating mode. Expansion devices 13 and 24 are by-directional-flow devices. During the heating mode the evaporator 14 functions as a condenser, the liquid separator 21 as a receiver, the condenser 11 as an evaporator, and the superheating heat exchanger 15 does not recuperate any thermal loads.

The expansion device 13, the evaporator 14, the superheating heat exchanger 15, the liquid separator 21, the additional expansion device 24, and the check valves 27 and 28 may be fabricated as a separate evaporator unit 29.

The liquid separator 21 and two split liquid lines introduced in FIG. 6 are optional.

The condenser 11 may be a base for a condenser unit having the same component structure as the evaporator unit 29. FIG. 11 is a good illustration of this case: the unit condenser unit has a condenser, which is the evaporator 14, a receiver, which is the liquid separator 21, the expansion devices 13 and 24, and the disabled superheating heat exchanger 15. Again, the liquid separator 21 and two split liquid lines introduced in FIG. 6 are optional for the condenser unit.

Figure 12:
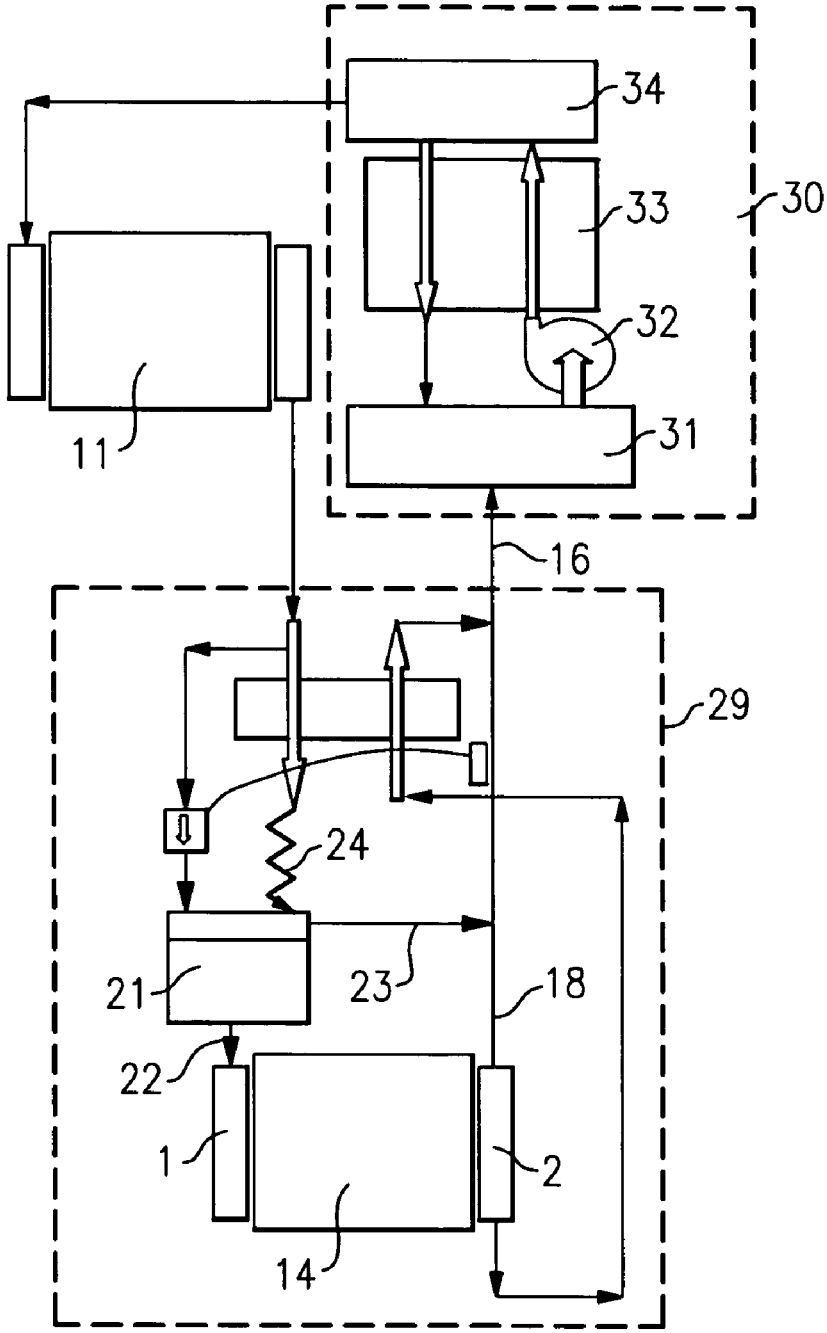
FIG. 12 is a schematic illustration of an absorption refrigeration system in accordance with one aspect of the invention.

FIG. 12 shows an absorption system with evaporator concept shown in FIG. 9. In addition to components in FIG. 9 the absorption system has a pressurizing means 30, which includes a closed loop with the following components of absorption systems: an absorber 31, a pump 32, a heat exchanger 33, a generator 34, and a condenser 11. As it was mentioned above the liquid separator 21 and two split liquid lines introduced in FIG. 6 are optional. As well, a liquid-to-suction heat exchanger is optionally applicable in the same way as the liquid-to-suction heat exchanger shown on FIG. 4.

While certain preferred embodiments of the present invention have been disclosed in detail, it is to be understood that various modifications in its structure may be adopted without departing from the spirit of the invention or the scope of the following claims.

We claim:

1. A refrigeration system having in closed loop relationship a pressurizer, a condenser, an expansion device and an evaporator, with the evaporator having an inlet header, an outlet header and a plurality of channels fluidly interconnecting the inlet header to the outlet header, comprising:

a superheating heat exchanger fluidly interconnected within the system and having a high pressure side and a low pressure side being thermally connected, and with said high pressure side fluidly interconnecting the condenser to the inlet header by way of the expansion device and said low pressure side fluidly interconnecting said outlet header to said pressurizer wherein said outlet header includes a liquid outlet and a vapor outlet, and means for separating refrigerant liquid from refrigerant vapor;

said liquid outlet is fluidly connected to said superheating heat exchanger;

said vapor outlet is fluidly connected to the pressurizer;

said superheating heat exchanger is so sized as to cause complete evaporation to a vapor of the liquid refrigerant flowing from said liquid outlet; and said superheating heat exchanger is further so sized as to cause superheating of the refrigerant vapor.

2. A refrigeration system as set forth in claim 1 wherein said separation means is adapted to use gravity to separate the refrigerant liquid from the refrigerant vapor.

3. A refrigeration system as set forth in claim 2 wherein said liquid outlet is at the bottom of said outlet header.

4. A refrigeration system as set forth in claim 2 wherein said vapor outlet is at the top of said outlet header.

5. A refrigeration system as set forth in claim 1 wherein said vapor outlet includes a restriction therein to compensate for a pressure drop in said low pressure side of said superheating heat exchanger.

6. A refrigeration system as set forth in claim 1 wherein said vapor outlet is connected to the driving side of an ejector pump, vapor outlet of said superheating heat exchanger is connected to the driven side of the ejector pump and the combined vapor stream from the ejector outlet is connected to said pressurizer.

7. A refrigeration system as set forth in claim 1 wherein said pressurizer comprises a compressor.

8. A refrigeration system as set forth in claim 1 wherein said pressurizer comprises an absorber, a pump and a generator.

9. A refrigeration system as set forth in claim 1 wherein said expansion device is an expansion valve and further wherein said vapor outlet includes a pressure sensing bulb for responsively controlling said expansion valve.

10. A refrigeration system as set forth in claim 1 wherein, in addition to said condenser being fluidly interconnected to said inlet header by way of said superheating heat exchanger high pressure side, there is included a parallel interconnection between said condenser and said inlet header.

11. A refrigeration system as set forth in claim 10 wherein said parallel interconnection includes a second expansion device.

12. A refrigeration system as set forth in claim 11 wherein said parallel interconnection is adapted to carry a major portion of liquid refrigerant from said condenser, and said high pressure side is adapted to carry a lesser portion of liquid refrigerant.

13. A refrigeration system as set forth in claim 11 wherein said second expansion device is controlled by a pressure sensor at said vapor outlet.

14. A refrigeration system as set forth in claim 12 and including a pressure sensor at the downstream side of said superheating heat exchanger low pressure side, and said expansion device is an expansion valve with an orifice and is controllably attached thereto.

15. A refrigeration system as set forth in claim 14 wherein said expansion valve is operated such that its orifice is opened when superheat decreases and is closed when superheat increases.

16. A refrigeration system as set forth in claim 10 wherein said expansion device is a capillary tube.

17. A refrigeration system as set forth in claim 16 wherein said capillary tube is contained within said superheater heat exchanger.

18. A refrigeration system as set forth in claim 1 and including a second means for separating refrigerant liquid from refrigerant vapor, said second separating means being fluidly interconnected between said expansion device and said inlet header.

19. A refrigeration system as set forth in claim 18 wherein said second separation means is adapted to pass refrigerant liquid to said inlet header and to pass refrigerant vapor to said pressurizer.

20. A refrigeration system as set forth in claim 10 and including a second means for separating refrigerant liquid from refrigerant vapor, said second separation means being fluidly interconnected between said inlet header and both said high pressure side and said parallel interconnection.

21. A refrigeration system as set forth in claim 1 and including a second heat exchanger between said condenser and said superheating heat exchanger, said second heat exchanger having high pressure and low pressure sides being in thermal contact, with said high pressure side transferring liquid refrigerant to said superheating heat exchanger and said low pressure side transferring vapor from said low pressure side of the superheater heat exchanger to said pressurizer.

22. A refrigeration system as set forth in claim 16 and including a four-way valve for selectively reversing the flow of refrigerant within the system to accommodate either heating or cooling modes of operation.

23. A refrigeration system as set forth in claim 22 and including an accumulator to accommodate refrigerant charge imbalance in the cooling and heating modes of operation.

24. A refrigeration system as set forth in claim 22 and including a check valve at the liquid outlet to disable the flow of liquid refrigerant during heating mode operation.

* * * * *

UNITED STATES PATENT AND TRADEMARK OFFICE

CERTIFICATE OF CORRECTION

PATENT NO. : 7,377,126 B2
APPLICATION NO. : 11/180774
DATED : May 27, 2008
INVENTOR(S) : Mikhail B. Gorbounov et al.

It is certified that error appears in the above-identified patent and that said Letters Patent is hereby corrected as shown below:

Title page 1 item 56 under References Cited, remove "2,097,602 A 11/1937 Rong" and replace with --2,097,602 A 11/1937 Rohlin--.

Title page 2 under Foreign Patent Documents, add --GB 2250336 6/1992 Nippondenso Co. Ltd.--

Signed and Sealed this

Fifth Day of August, 2008

JON W. DUDAS
*Director of the United States Patent and Trademark Office*